US007967641B2

(12) United States Patent
Miyoshi

(10) Patent No.: US 7,967,641 B2
(45) Date of Patent: Jun. 28, 2011

(54) CONNECTOR

(75) Inventor: Toshiharu Miyoshi, Osaka (JP)

(73) Assignee: Hosiden Corporation, Yao-shi, Osaka (JP)

( * ) Notice: Subject to any disclaimer, the term of this patent is extended or adjusted under 35 U.S.C. 154(b) by 153 days.

(21) Appl. No.: 12/458,612

(22) Filed: Jul. 17, 2009

(65) Prior Publication Data

US 2010/0015831 A1 Jan. 21, 2010

(30) Foreign Application Priority Data

Jul. 18, 2008 (JP) ..... 2008-187129

(51) Int. Cl.
*H01R 24/00* (2011.01)

(52) U.S. Cl. ..... 439/660; 439/862

(58) Field of Classification Search ..... 439/660, 439/676, 862, 941
See application file for complete search history.

(56) References Cited

U.S. PATENT DOCUMENTS 3,275,765 A * 9/1966 Ferdon et al. ..... 200/51.1
3,474,380 A * 10/1969 Miller ..... 439/752
6,086,401 A * 7/2000 Hsiung et al. ..... 439/342
6,280,251 B1 8/2001 Nishio
6,283,774 B1 * 9/2001 Funatsu ..... 439/181
7,052,284 B2 * 5/2006 Liao et al. ..... 439/66
7,335,036 B1 2/2008 Lin
7,402,088 B2 * 7/2008 Hsu et al. ..... 439/862
7,578,675 B2 * 8/2009 Polnyl et al. ..... 439/66
7,806,704 B2 * 10/2010 Miyoshi et al. ..... 439/108
2010/0015831 A1 * 1/2010 Miyoshi ..... 439/218
2010/0022138 A1 * 1/2010 Miyoshi et al. ..... 439/660

FOREIGN PATENT DOCUMENTS

JP 2000-223215 8/2000

* cited by examiner

*Primary Examiner* — James Harvey
(74) *Attorney, Agent, or Firm* — Bacon & Thomas, PLLC

(57) ABSTRACT

It is an object of the invention to provide a connector in which a plurality of stationary contacts 5 are arranged on an insulator 3, a plurality of cantilevered movable contacts 8 are arranged in rear of the stationary contacts while tip end sides are placed in a front side, and, even when at least one specific stationary contact 5*b* of the stationary contacts 5 and at least one specific movable contact 8*b* of the movable contacts 8 are arranged in substantially one row in a state where the specific contacts are anteroposteriorly close to each other, tip end portions of all of the movable contacts can be engaged with the insulator.

5 Claims, 9 Drawing Sheets

CONNECTOR

TECHNICAL FIELD

The present invention relates to a connector which connects, for example, a personal computer to a peripheral device such as a keyboard, a mouse, a joystick, a modem, a printer, or an external HDD (Hard Disk Drive), and more particularly to a connector which can be preferably used in a USB (Universal Serial Bus) connection.

BACKGROUND ART

A USB connector for a USB connection is configured by: a connector socket which is to be mounted on a printed circuit board of a personal computer or the like; and a connector plug which is to be attached to an end of a connection cable of a peripheral device, and the front end (tip end) of the connector plug is inserted into the connector socket, thereby connecting the personal computer to the device.

The connector socket has: a rectangular tubular shield case which is formed by punching and bending a metal sheet; and a planar insulator which is attached into the shield case. Four contact housing grooves are laterally arranged in the lower surface of the insulator. Cantilevered movable contacts are attached to the contact housing grooves while directing their tip ends toward the front side, respectively, so that four movable contacts are laterally arranged on the insulator. Each of the movable contacts is configured by a thin terminal (plate spring) which is formed by punching and bending a metal sheet, and a downward-directed mountain-like contact portion in which the upper face is concave and the lower face is convex is bendingly formed in the tip end side. The contact portion is projected from the lower surface of the insulator.

The connector plug has: a rectangular tubular shield case which is formed by punching and bending a metal sheet; and a planar insulator which is attached into the shield case. Four stationary contacts are laterally arranged in the upper surface of the insulator. Each of the stationary contacts is configured by a thin terminal which is formed by punching and bending a metal sheet. The upper surfaces of the contacts are exposed substantially flushly from the upper surface of the insulator.

When the connector plug is inserted into the connector socket, the shield case of the connector plug is fitted to the inside of the shield case of the connector socket, and the insulator of the connector plug is superimposed on the lower side of the insulator of the connector socket. In this case, the four stationary contacts disposed in the connector plug are contacted with the contact portions of the four movable contacts disposed in the connector socket while pressing up them, thereby making electrical connections.

In the movable contacts (the four movable contacts disposed in the connector socket) of the USB connector, a structure is employed where, when the connector plug is not inserted, tip end portions which are further extended from the contact portions are engaged with the insulator before the movable contacts are returned to their free positions (for example, see Patent Literature 1).

PRIOR ART LITERATURE

Patent Literature

[Patent Literature 1] Japanese Patent Application Laying-Open No. 2000-223215

SUMMARY OF THE INVENTION

Problems to be Solved by the Invention

In the case where, in order to enhance the transmission speed in a USB connection, the number of contacts of a USB connector is increased from four in the prior art by, for example, five to nine, the USB connector must maintain downward compatibility, or namely the resulting connector must be a connector which can be used for existing USB devices.

FIG. 1 shows the contact arrangement of a connector plug in a USB connector in which the number of contacts is increased (i.e., the figure shows the problems to be solved by the invention). In FIG. 1, 100 denotes a planar insulator corresponding to the planar insulator in the connector plug where the number of contacts is not increased, 101 denotes four stationary contacts corresponding to the four stationary contacts in the connector plug where the number of contacts is not increased, and 102 denotes five contacts which are increased, and which, in the example, are cantilevered movable contacts.

Similarly with the four stationary contacts in the connector plug where the number of contacts is not increased, the stationary contacts 101 are configured by thin terminals which are formed by punching and bending a metal sheet, and the four contacts are laterally arranged on the insulator 100 in the state where the upper surfaces of the contacts are exposed substantially flushly from the upper surface of the insulator 100. The movable contacts 102 are disposed respectively while the tip ends are placed on the front side, in five contact housing grooves 103 which are laterally arranged in the upper surface of the insulator 100 that is in rear of the stationary contacts 101, so that the five contacts are laterally arranged on the side of the insulator that is in rear of the stationary contacts 101. Each of the movable contacts 102 is configured by a thin terminal (plate spring) which is formed by punching and bending a metal sheet, and, in the tip end side, an upward-directed mountain-like contact portion 104 in which the upper face is convex and the lower face is concave are bendingly formed. The contact portions 104 are projected from the upper surface of the insulator 100.

In the USB connector where the number of contacts is increased, when the connector plug is inserted into the connector socket, similarly with the USB connector where the number of contacts is not increased, the shield case of the connector plug is fitted to the inside of the shield case of the connector socket, and the insulator 100 of the connector plug is superimposed on the lower side of the insulator of the connector socket. In this case, the four stationary contacts 101 disposed in the connector plug are contacted with the contact portions of the four movable contacts disposed in the connector socket while pressing up them, and then the contact portions 104 of the five movable contacts 102 which are increased in the connector plug are contacted with the five stationary contacts which are increased in the connector socket while being pressed down, thereby making electrical connections.

In the movable contacts of the connector plug of the USB connector where the number of contacts is increased, the inner three movable contacts 102 are placed in rear of the portions between the four stationary contacts 101, so as not to be arranged in substantially one row in a state where the inner movable contacts are anteroposteriorly close to all of the stationary contacts 101. Because of width relationships with the insulator 100, by contrast, the outer (right and left end) two movable contacts 102 are placed in rear of the outer (right and left end) two stationary contacts 101, so as to be arranged in substantially one row in a state where the outer movable contacts are anteroposteriorly close to the outer two stationary contacts 101, respectively.

As in the movable contacts of the USB connector where the number of contacts is not increased, in the case where, when the connector plug is not inserted, tip end portions which are further extended from the contact portions 104 are to be engaged with the insulator 100, interference is caused between the outer two movable contacts 102 and the outer two stationary contacts 101. As shown in FIG. 1, therefore, the tip end portions of the all movable contacts cannot be engaged with the insulator. Consequently, the levels of the contact portions 104 in the initial state (when the connector plug is not inserted, i.e., when the connector is not fitted) of the movable contacts 102 become unstable, and hence a stable contact pressure cannot be obtained when the connector plug is inserted, i.e., when the connector is fitted. When the connector plug is not inserted, moreover, a preload (initial load) cannot be applied to the movable contacts 102, and hence the levels of the contact portions 104 in the initial state must be higher as compared with the movable contacts in which the tip end portions are engaged with the insulator (at the same levels or the same amount of flexure, the same contact pressure is not obtained, and the contact pressure is reduced). Therefore, there arises a problem in that, when the connector plug is inserted, buckling easily occurs in the movable contacts 102.

The invention has been conducted in view of the above-discussed problems. It is an object of the invention to provide a connector in which a plurality of stationary contacts are arranged on an insulator, a plurality of cantilevered movable contacts are arranged in rear of the stationary contacts while tip end sides are placed in a front side, and, even when at least one specific stationary contact of the stationary contacts and at least one specific movable contact of the movable contacts are arranged in substantially one row in a state where the specific contacts are anteroposteriorly close to each other, tip end portions of all of the movable contacts can be engaged with the insulator.

Means for Solving the Problems

In order to attain the object, as set forth in claim 1, in the connector of the invention, a plurality of stationary contacts are arranged on an insulator, a plurality of cantilevered movable contacts are arranged in rear of the stationary contacts while tip end sides are placed in a front side, at least one specific stationary contact of the stationary contacts and at least one specific movable contact of the movable contacts are arranged in substantially one row in a state where the specific contacts are anteroposteriorly close to each other, and the specific movable contact has a tip end portion which is more forward than a contact portion, and which is positionally shifted from the contact portion in one of rightward and leftward directions.

In the connector of the invention, as set forth in claim 2, preferably, the tip end portion of the specific movable contact is formed at a position which is below the specific stationary contact, and which is shifted in one of rightward and leftward directions from the specific stationary contact, through a continuous portion which is downward obliquely extended in one of rightward and leftward directions from the contact portion of the specific movable contact, and engaged with a contact engaging portion disposed in the insulator, before the specific movable contact returns to a free position.

As set forth in claim 3, preferably, a rear end portion of the specific stationary contact is downward obliquely extended in another one of rightward and leftward directions, the other direction being opposite to the continuous portion of the specific movable contact.

As set forth in claim 4, preferably, at least one chamfered portion is disposed in the specific stationary contact, and a chamfered region of the chamfered portion is in front of the contact portion of the specific movable contact.

As set forth in claim 5, the number of the stationary contacts is four, and the number of the movable contacts is five, thereby constituting a connector plug of a USB connector, i.e., a USB connector where the number of contacts is increased.

Effects of the Invention

According to the connector of the invention, the plurality of stationary contacts are arranged on the insulator, the plurality of cantilevered movable contacts are arranged in rear of the stationary contacts while the tip end sides are placed in the front side, and, even when at least one specific stationary contact of the stationary contacts and at least one specific movable contact of the movable contacts are arranged in substantially one row in a state where the specific contacts are anteroposteriorly close to each other, the specific movable contact has the tip end portion which is more forward than the contact portion, and which is positionally shifted from the contact portion in one of rightward and leftward directions. Therefore, the tip end portion of the specific movable contact can be engaged with the insulator without causing interference with the specific stationary contact, and the tip end portions of all of the movable contacts can be engaged with the insulator. Consequently, the levels of the contact portions of the movable contacts in the initial state are stabilized, and hence a stable contact pressure can be obtained. Moreover, the movable contacts can be preloaded, and hence the levels of the contact portions in the initial state can be lowered as compared with the movable contacts in which the tip end portions are not engaged with the insulator, thereby attaining a remarkable effect that buckling hardly occurs in the movable contacts.

MODE FOR CARRYING OUT THE INVENTION

Figure 1:
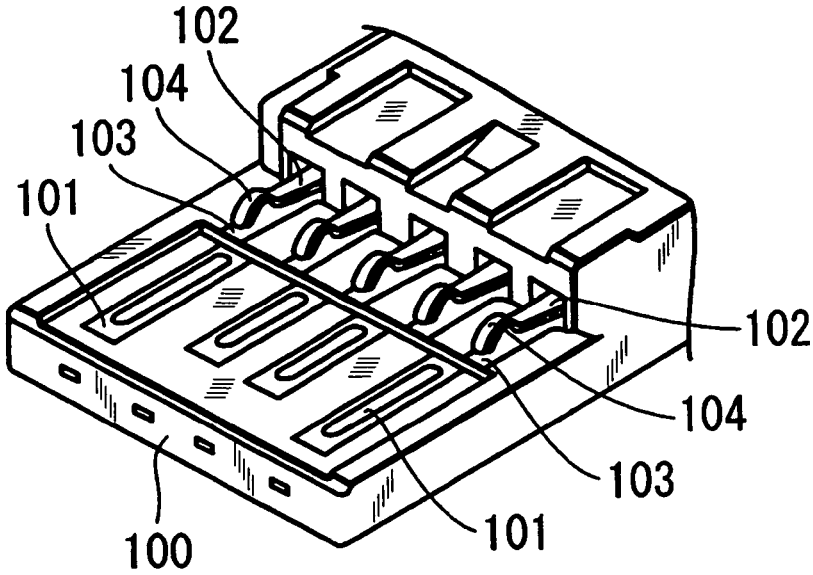
FIG. 1 is a view showing the contact arrangement of a connector plug in a USB connector in which the number of contacts is increased (a view showing the problems to be solved by the invention).

Hereinafter, an embodiment of the invention will be described in detail with reference to the drawings. In the embodiment, the invention will be described by means of a connector plug which is a USB connector where the number of contacts is increased while maintaining compatibility with a USB connector where the number of contacts is not increased, and which is to be inserted from the front end (tip end) into a connector socket to be connected therewith.

Referring to FIGS. 2 to 5B, a connector plug 1 has: a rectangular tubular shield case 2 which corresponds to a rectangular tubular shield case of a connector plug where the number of contacts is not increased, and which is formed by punching and bending a metal sheet; and a planar insulator 3 which corresponds to a planar insulator of the connector plug where the number of contacts is not increased, and which is attached into the shield case 2. A space 4 is disposed between a top plate portion of the shield case 2 and the upper surface of the insulator 3. The space 4 is opened in the forward direction of the connector plug 1.

In a front portion of the upper surface of the insulator 3, four stationary contacts 5 which correspond to four stationary contacts of the connector plug where the number of contacts is not increased are laterally arranged. The stationary contacts 5 are configured by thin terminals which are formed by punching and bending a metal sheet, respectively, and integrated with the insulator 3 by, for example, insert molding, and their upper surfaces are exposed substantially flushly from the upper surface of the insulator 3, so that four rectangular contact portions (stationary contacts) which are elongated in the anteroposterior direction are laterally arranged in a front portion of the upper surface of the insulator 3. The stationary contacts 5 are downward extended in the insulator 3 from front end portions of the contact portions, and then forward extended to the front end of the insulator 3. The stationary contacts 5 are downward extended in the insulator 3 from rear end portions of the contact portions, and then rearward extended to be rearward projected from a rear end portion of the insulator 3. The projected portions form external connection terminals 6.

In the upper surface of the insulator 3 and in rear of the stationary contacts 5, five thin contact housing grooves 7 which are anteroposteriorly elongated, and in which the depth is deeper as further advancing toward the front side are formed so as to be laterally arranged. Cantilevered movable contacts 8 which are anteroposteriorly elongated are attached to the contact housing grooves 7 while directing their tip ends toward the front side, respectively, so that the five movable contacts 8 are laterally arranged on the insulator 3 in rear of the stationary contacts 5. Each of the movable contacts 8 is configured by a thin terminal (plate spring) which is formed by punching and bending a metal sheet, and the basal portion (rear portion) is fixed by the rear portion of the corresponding contact housing groove 7. The movable contacts 8 are upward elongated from the basal portions, and then further rearward elongated to be rearward projected from the rear end portion of the insulator 3. The projected portions form external connection terminals 9. The movable contacts 8 are extended forward obliquely upward from the basal portions to form spring portions 10 which are vertically flexurally deformed. In each of the movable contacts 8, a contact portion (movable contact) 11 having an upward-directed mountain-like shape in which the upper face is convex and the lower face is concave, and which is vertically displaceable is bendingly formed in a tip end portion of the spring portion 10. The contact portions 11 are projected from the front end portions of the contact housing grooves 7 to the upper surface of the insulator 3.

When the connector plug 1 is inserted into the connector socket, similarly with the USB connector where the number of contacts is not increased, the shield case 2 of the connector plug 1 is fitted to the inside of the shield case of the connector socket, the insulator of the connector socket is inserted into the space 4 of the connector plug 1, and the insulator 3 of the connector plug 1 is superimposed on the lower side of the insulator of the connector socket. In this case, the four stationary contacts 5 disposed in the connector plug 1 are contacted with the contact portions of the four movable contacts disposed in the connector socket while pressing up them, and then the contact portions 11 of the five movable contacts 8 which are increased in the connector plug 1 are contacted with the stationary contacts 11 of the five movable contacts 8 which are increased in the connector socket while being pressed down (while being pressed into the contact housing grooves 7), thereby making electrical connections.

Figure 2:
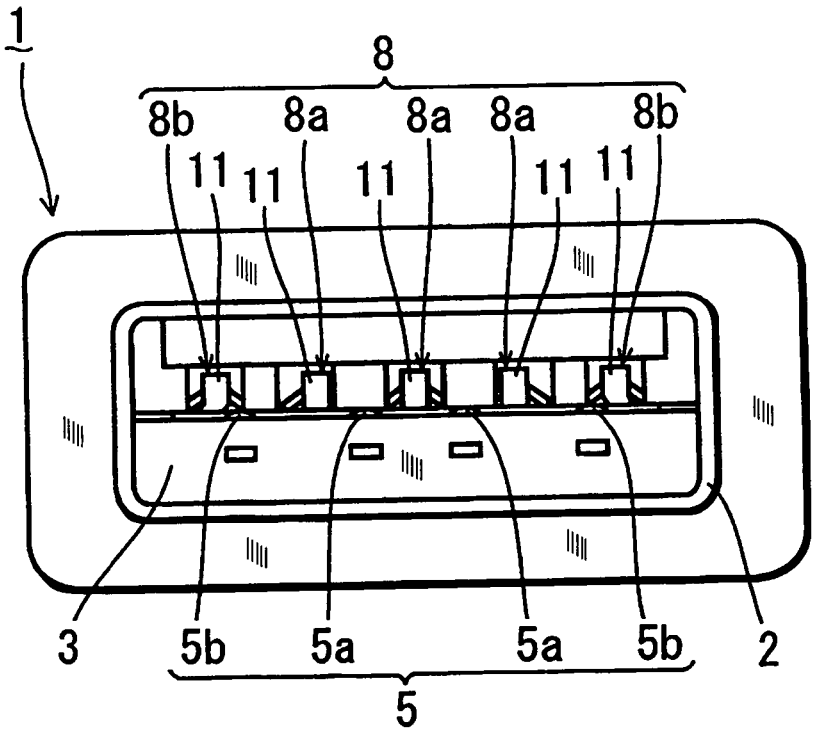
FIG. 2 is a front view of a connector (a connector plug in a USB connector where the number of contacts is increased) of an embodiment of the invention.
Figure 3:
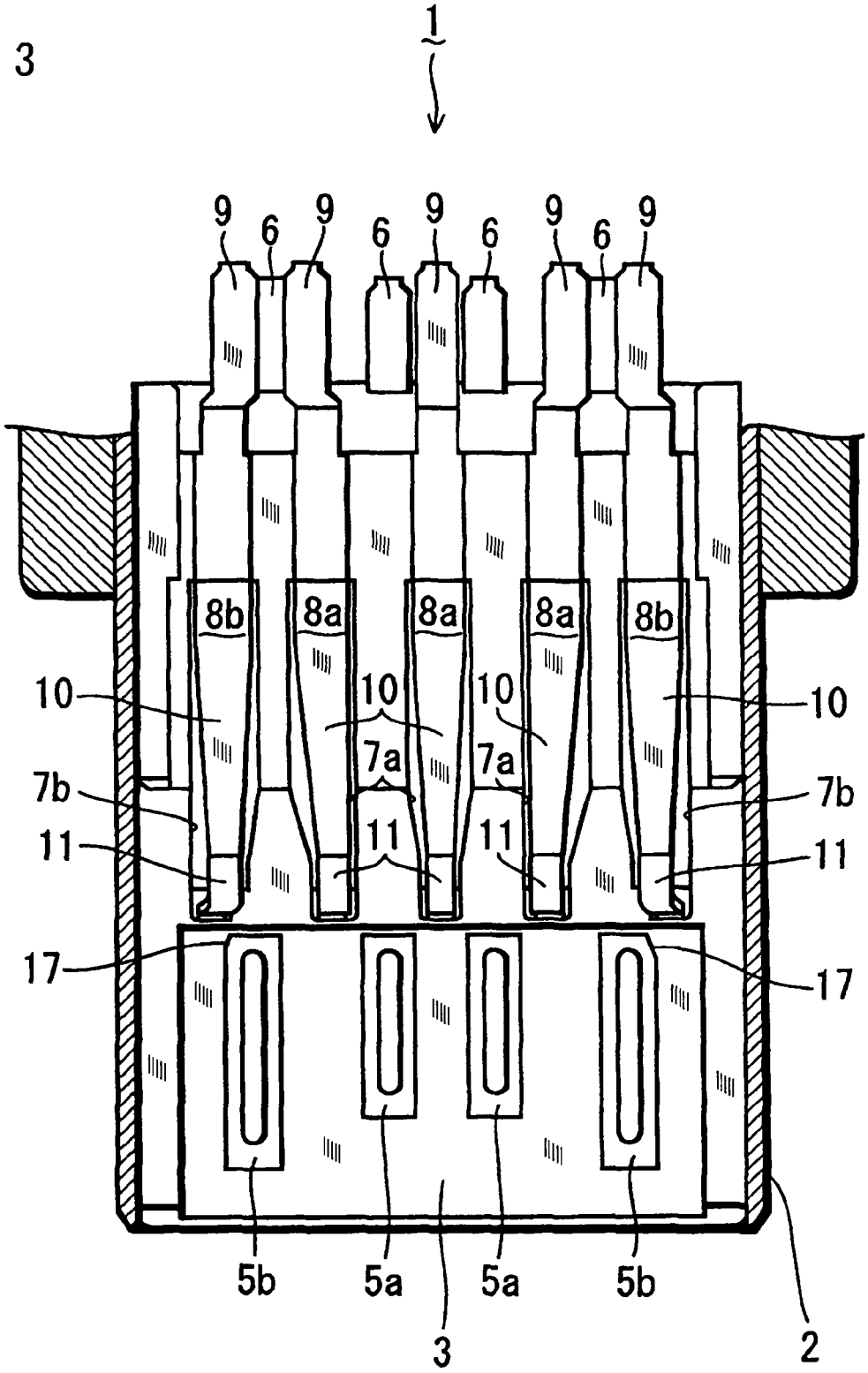
FIG. 3 is a plan view showing the contact arrangement of the connector of the embodiment of the invention.

In the movable contacts 8 of the connector plug 1, as shown in FIGS. 2 and 3, the inner three contact housing grooves 7 and movable contacts 8 are placed in rear of the portions between the four stationary contacts 5, so as not to be arranged in substantially one row in a state where the groves and the contacts are anteroposteriorly close to all of the stationary contacts 5. Because of width relationships with the insulator 3, by contrast, the outer (right and left end) two contact housing grooves 7 and movable contacts 8 are placed in rear of the outer (right and left end) two stationary contacts 5, so as to be arranged in substantially one row in a state where the grooves and the contacts are anteroposteriorly close to the outer two stationary contacts 5, respectively.

In the connector plug 1, the plurality (in the embodiment, four) of stationary contacts 5 are arranged on the insulator 3, the plurality (in the embodiment, five) of contact housing grooves 7 are arranged in rear of the stationary contacts 5 of the insulator 3, the cantilevered movable contacts 8 are attached to the contact housing grooves 7 while tip end sides are placed in the front side, respectively, the plurality (in the embodiment, five) of cantilevered movable contacts 8 are arranged in rear of the stationary contacts 5 of the insulator 3 while tip end sides are placed in the front side, and the stationary contacts 5, and the contact housing grooves 7 and the movable contacts 8 include: at least one stationary contact 5*a* (in the embodiment, the inner two stationary contacts 5), and at least one contact housing groove 7*a* and movable contact 8*a* (in the embodiment, the inner three contact housing grooves 7 and movable contacts 8) which are not arranged in substantially one row in a state where they are anteroposteriorly close to each other; and at least one specific stationary contact 5*b* (in the embodiment, the outer two stationary contacts 5), and at least one specific contact housing groove 7*b* and specific movable contact 8*b* (in the embodiment, the outer two contact housing grooves 7 and movable contacts 8) which are arranged in substantially one row in a state where they are anteroposteriorly close to each other.

In the following description, in contrast to the specific stationary contact 5*b*, and specific contact housing groove 7*b* and specific movable contact 8*b* which are arranged in substantially one row in a state where they are anteroposteriorly close to each other, the stationary contact 5*a*, and contact housing groove 7*a* and movable contact 8*a* which are not arranged in substantially one row in a state where they are anteroposteriorly close to each other are referred to as "ordinary stationary contact 5*a*", and "ordinary contact housing groove 7*a*" and "ordinary movable contact 8*a*", respectively, the ordinary stationary contact 5*a* and the specific stationary contact 5*b* are generally referred to as "stationary contacts 5", similarly the ordinary contact housing groove 7*a* and the specific contact housing groove 7*b* are generally referred to as "contact housing grooves 7", and the ordinary movable contact 8*a* and the specific movable contact 8*b* are generally referred to as "movable contacts 8".

Then, tip end portions (front end portions) of the all movable contacts 5 are engaged with the insulator 3. Next, engagement structures for the movable contacts will be described with reference to FIGS. 4A to 8B.

First, the engagement structure for the ordinary movable contacts 8*a* will be described with reference to FIGS. 4A, 5A, 6A, 7A, 7B, and 8A.

Figure 5A:
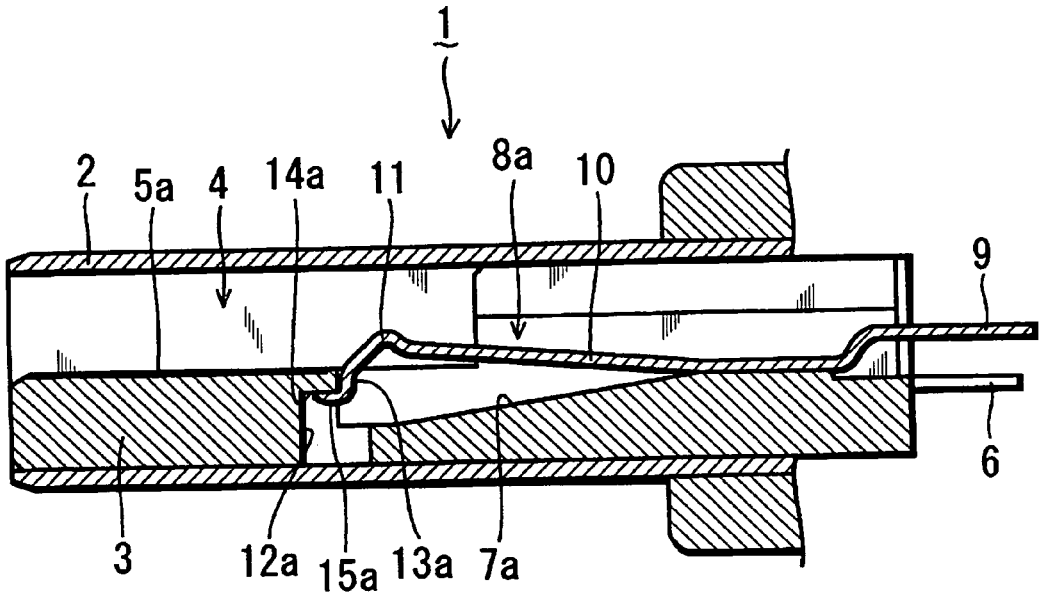
FIG. 5A is a sectional view of an ordinary movable contact portion of the connector of the embodiment of the invention.
Figure 8A:
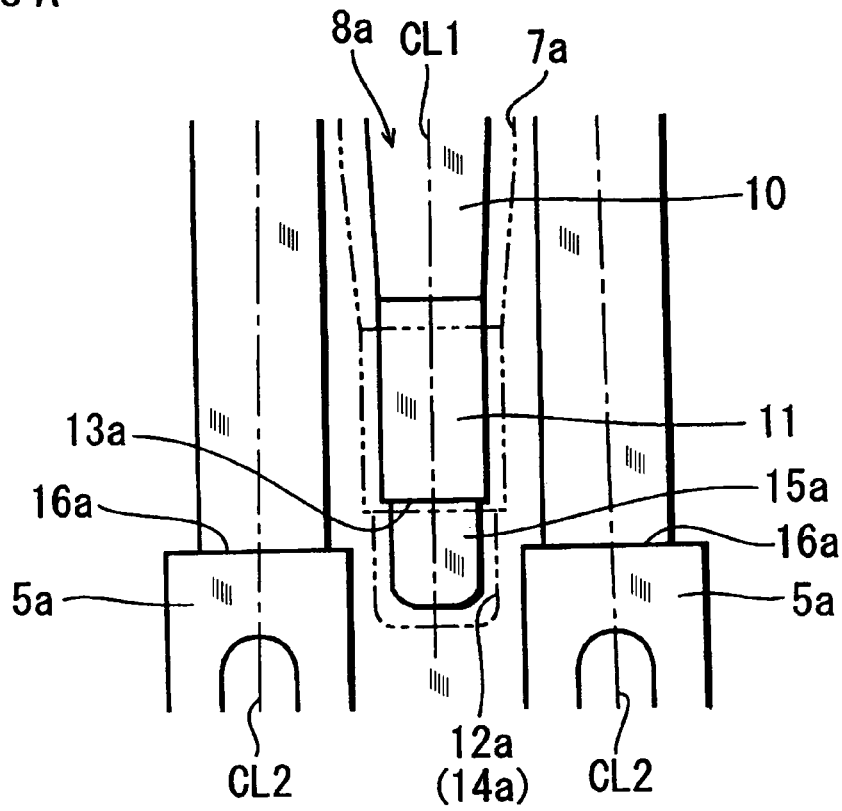
FIG. 8A is a plan view showing an engagement structure of the ordinary movable contact portion of the connector of the embodiment of the invention.

As described above, the ordinary contact housing grooves 7*a* and the ordinary movable contacts 8*a* are placed in rear of the portions between the stationary contacts 5, and, even when each of the ordinary movable contacts 8*a* is forward extended from the contact portion 11 without causing positional shifting with respect to the corresponding stationary contact 5 in both lateral directions, the ordinary movable contact does not interfere with all of the stationary contacts 5. As shown in FIGS. 5A and 8A, in each of the ordinary contact housing grooves 7*a*, therefore, a lower portion of the groove wall face at the front end is further forward cut away substantially coaxially with the center line CL1 of the contact portion 11 of the ordinary movable contact 8*a*, to dispose a ceiled contact-tip end portion housing groove 12*a*, between the rear end portions of the stationary contacts 5 and below the stationary contacts 5.

As shown in FIGS. 5A, 7A, 7B, and 8A, each of the ordinary movable contacts 8*a* is further extended from the corresponding contact portion 11 to have an L-like sectional shape, and, in the tip end side of the contact portion 11, a continuous portion 13*a* and a tip end portion 15*a* are disposed. The continuous portion 13*a* is downward extended in the ordinary contact housing groove 7*a* to the rear side of the contact-tip end portion housing groove 12*a*, without causing positional shifting with respect to the contact portion 11 in both lateral directions. The tip end portion 15*a* is forward extended in the contact-tip end portion housing groove 12*a* through the continuous portion 13*a*, along the ceiling plane of the contact-tip end portion housing groove 12*a* without causing positional shifting with respect to the contact portion 11 in both lateral directions, and opposed from the lower side to a contact engaging portion 14*a* which is disposed in the insulator 3 by the ceiling plane of the groove.

When the connector plug 1 is not inserted, before the ordinary movable contact 8*a* is caused to return to a free position by the elasticity of the spring portion 10, the tip end portion 15*a* of the ordinary movable contact 8*a* is engaged from the lower side with the contact engaging portion 14*a* disposed in the insulator 3, substantially coaxially with the center line CL1 without causing interference with all of the stationary contacts 5, thereby preloading the ordinary movable contact 8*a*.

As shown in FIG. 5A, in order that, when the connector plug 1 is inserted and the contact portion 11 of the ordinary movable contacts 8*a* is pressed into the ordinary contact housing groove 7*a*, the tip end portion 15*a* of the ordinary movable contact 8*a* does not interfere with the insulator 3, the ordinary contact housing groove 7*a* and the contact-tip end portion housing groove 12*a* are opened in the lower surface of the insulator 3 below the tip end portion 15*a* of the ordinary movable contact 8*a*.

Figure 4A:
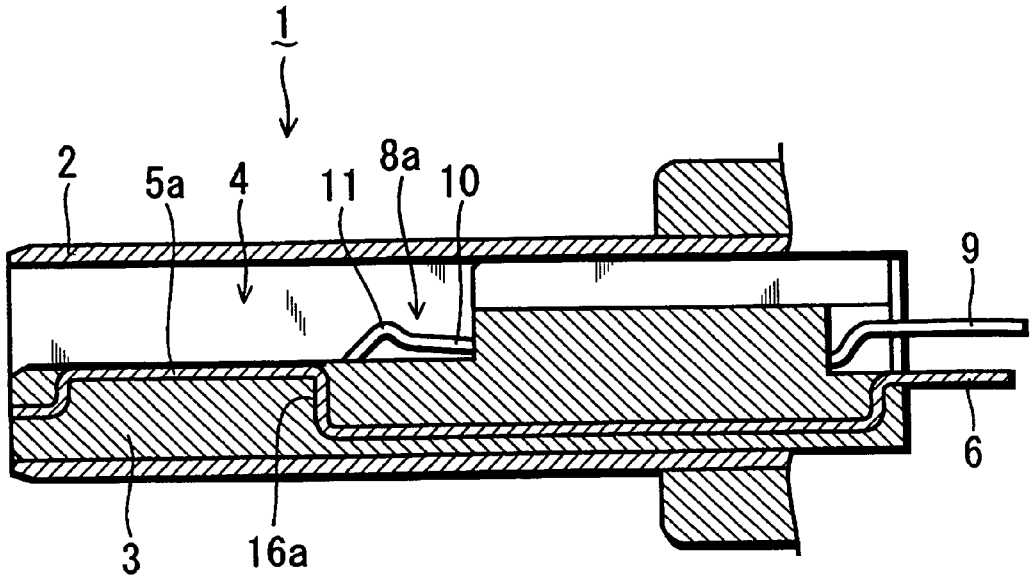
FIG. 4A is a sectional view of an ordinary stationary contact portion of the connector of the embodiment of the invention.
Figure 6A:
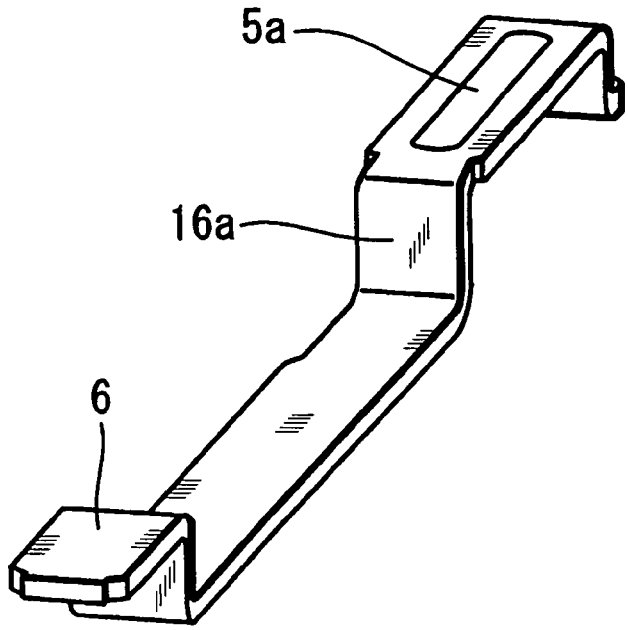
FIG. 6A is a perspective view showing the appearance of the ordinary stationary contact portion of the connector of the embodiment of the invention.

The ordinary stationary contacts 5*a* are placed in front of the portions between the ordinary contact housing grooves 7*a* and the ordinary movable contacts 8*a*. The rear end portions of the ordinary stationary contacts 5*a* are placed between engaging portions which are used for engaging the ordinary movable contacts 8*a* with the insulator 3, and each of which is configured by: the contact-tip end portion housing groove 12*a* of the ordinary contact housing groove 7*a*; the contact engaging portion 14*a* disposed in the insulator 3 by the ceiling plane of the contact-tip end portion housing groove 12*a*; and the tip end portion 15*a* of the ordinary movable contact 8*a*. Even when each of the ordinary stationary contacts 5*a* is downward extended from the rear end portion in the insulator 3 without causing positional shifting with respect to the ordinary stationary contact 5*a* in both lateral directions, the ordinary stationary contact does not interfere with the engaging portions of all of the ordinary movable contacts 8*a* with respect to the insulator 3. As shown in FIGS. 4A, 6A, and 8A, in each of the ordinary stationary contacts 5*a*, therefore, a bent portion 16*a* is disposed which is downward extended from the rear end portion in the insulator 3, without causing positional shifting with respect to the ordinary stationary contact 5*a* in both lateral directions, i.e., about the center line CL2 of the ordinary stationary contact 5*a*.

Next, the engagement structure of the ordinary movable contact 8*b* will be described with reference to FIGS. 4B, 5B, 6B, 7C, 7D, and 8B.

Figure 5B:
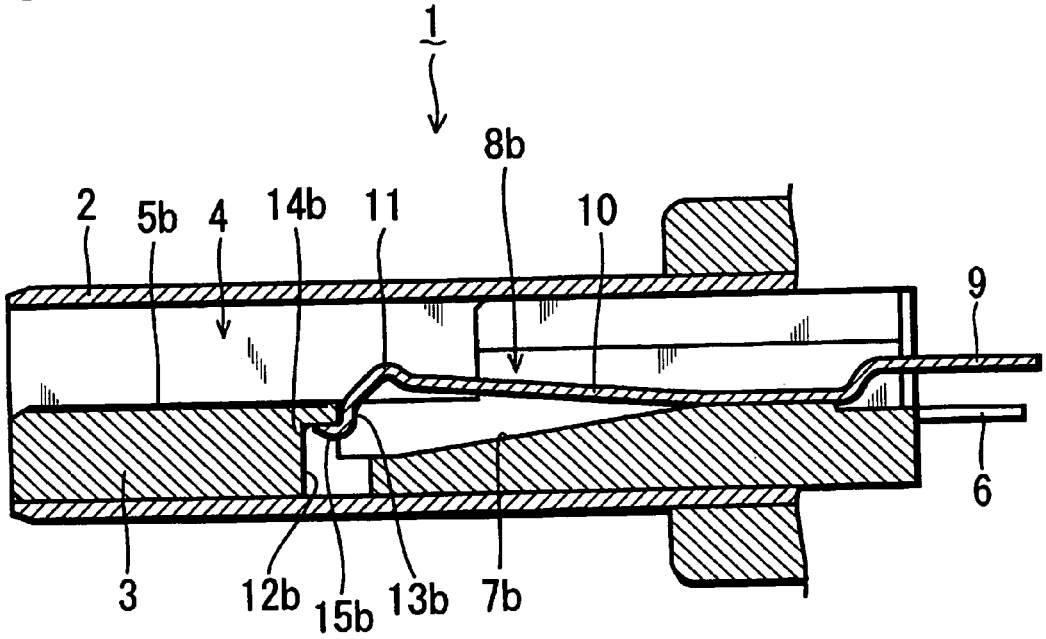
FIG. 5B is a sectional view of a specific movable contact portion of the connector of the embodiment of the invention.
Figure 8B:
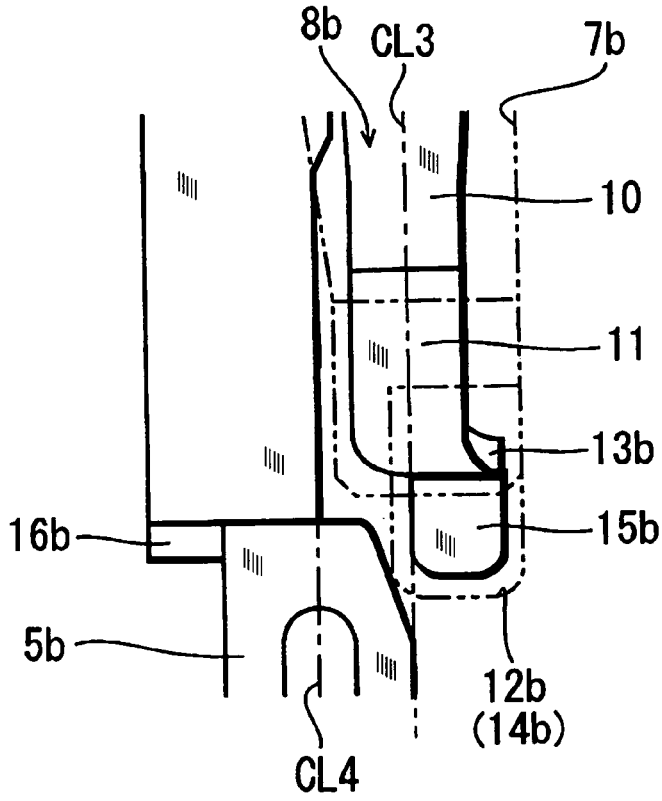
FIG. 8B is a plan view showing an engagement structure of the specific movable contact portion of the connector of the embodiment of the invention.
Figure 9A:
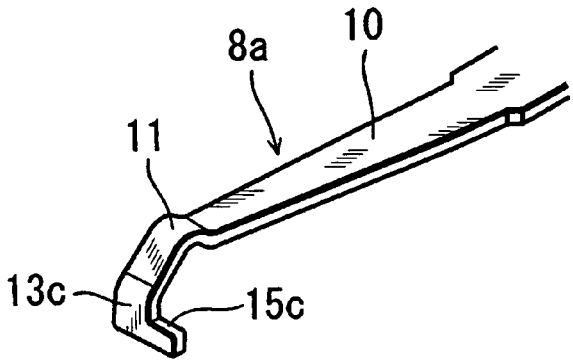
FIG. 9A is a perspective view showing a first modification of the shape of the tip end portion of the specific movable contact portion of the connector of the embodiment of the invention.
Figure 9B:
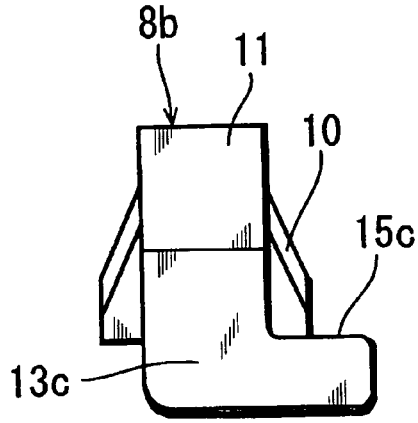
FIG. 9B is a front view showing the first modification of the shape of the shape of the tip end portion of the specific movable contact portion of the connector of the embodiment of the invention.

As described above, the specific contact housing groove 7*b* and the specific movable contact 8*b* are placed in rear of the specific stationary contact 5*b*. Specifically, with respect to the lateral positions of the specific contact housing groove 7*b* and the specific movable contact 8*b*, the outer half about the center line CL3 of the contact portion 11 of the specific movable contact 8*b* is outward deviated from the specific stationary contact 5*b*, but the inner half is superimposed on the specific stationary contact 5*b*. When the specific movable contact is forward extended from the contact portion 11 without causing positional shifting toward the outside, i.e., substantially coaxially with the center line CL3, the inner half about the center line CL3 interferes with the specific stationary contact 5*b*. As shown in FIGS. 5B and 8B, in each of the specific contact housing grooves 7*b*, therefore, a lower portion of the groove wall face at the front end is further forward cut away in the outer half about the center line CL3 (the left half in the left-end specific contact housing groove 7*b*, and the right half in the right-end specific contact housing groove 7*b*), i.e., at a position which is outward eccentric about the center line CL3, to dispose a ceiled contact-tip end portion housing groove 12*b* which is placed outside the rear end portion of the specific stationary contact 5*b* and below the specific stationary contact 5*b*.

As shown in FIGS. 5B, 7C, 7D, and 8B, each of the specific movable contacts 8*b* is further extended from the corresponding contact portion 11 to have an L-like sectional shape, and, in the tip end side of the contact portion 11, a continuous portion 13*b* and a tip end portion 15*b* are disposed. The continuous portion 13*b* is extended in the specific contact housing groove 7*b* to the rear side of the contact-tip end portion housing groove 12*b* in a downward oblique direction (a left downward direction in the left-end specific movable contact 8*b*, and a right downward direction in the right-end specific movable contact 8*b*). The tip end portion 15*b* is forward extended in the contact-tip end portion housing groove 12*b* through the continuous portion 13*b*, along the ceiling plane of the contact-tip end portion housing groove 12*b*, and opposed from the lower side to a contact engaging portion 14*b* which is disposed in the insulator 3 by the ceiling plane of the groove.

The tip end portion 15*b* of the specific movable contact 8*b* is outward positionally shifted from the contact portion 11. At a position which is outward eccentric about the center line CL3, when the connector plug 1 is not inserted, before the specific movable contact 8*b* is caused to return to a free position by the elasticity of the spring portion 10, the tip end portion 15*b* of the specific movable contact 8*b* is engaged from the lower side with the contact engaging portion 14*b* disposed in the insulator 3, without causing interference with the specific stationary contact 5*b*, thereby preloading the specific movable contact 8*b*.

As shown in FIG. 5B, in order that, when the connector plug 1 is inserted and the contact portion 11 of the specific movable contact 8*b* is pressed into the specific contact housing groove 7*b*, the tip end portion 15*b* of the specific movable contact 8*b* does not interfere with the insulator 3, the specific contact housing groove 7*b* and the contact-tip end portion housing groove 12*b* of the groove are opened in the lower surface of the insulator 3 below the tip end portion 15*b* of the specific movable contact 8*b*.

Figure 4B:
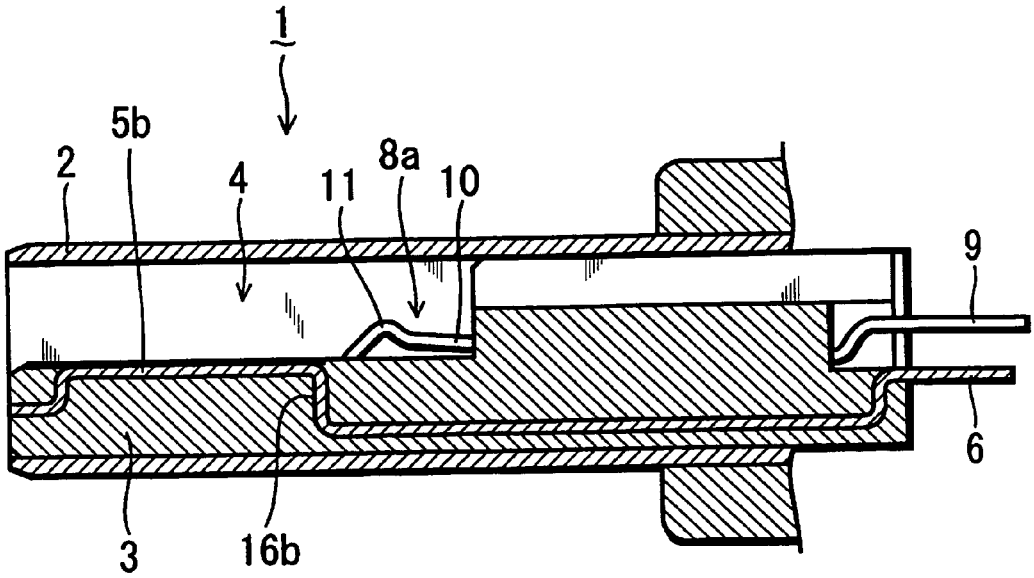
FIG. 4B is a sectional view of a specific stationary contact portion of the connector of the embodiment of the invention.
Figure 6B:
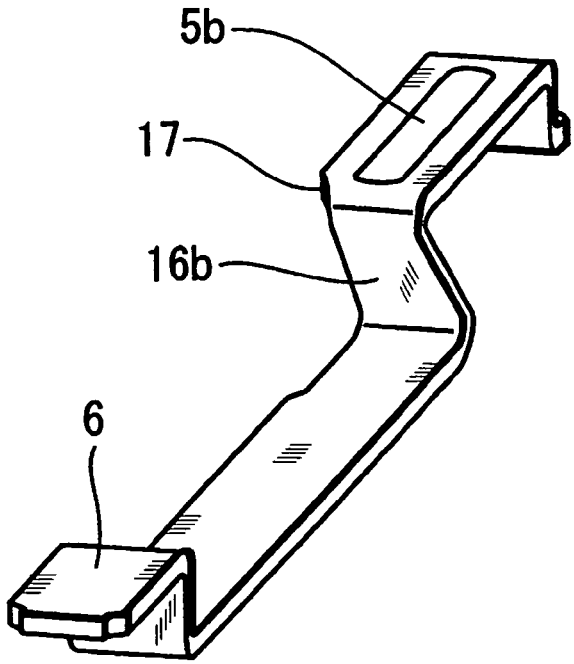
FIG. 6B is a perspective view showing the appearance of the specific stationary contact portion of the connector of the embodiment of the invention.

The specific stationary contacts 5*b* are placed in front of the specific contact housing grooves 7*b* and the specific movable contacts 8*b*. Specifically, with respect to the lateral position of each of the specific stationary contacts 5*b*, a substantially inner half about the center line CL4 of the specific stationary contact 5*b* is inward deviated from the specific contact housing groove 7*b* and the specific movable contact 8*b*, but a substantially outer half is superimposed on the specific contact housing groove 7*b* and the specific movable contact 8*b*. In the outside of the rear end portion of the specific stationary contact 5*b*, the contact-tip end portion housing groove 12*b* of the specific contact housing groove 7*b*, the contact engaging portion 14*b* disposed in the insulator 3 by the ceiling plane of the contact-tip end portion housing groove 12*b*, and an engaging portion which is used for engaging the specific movable contact 8*b* with the insulator 3, and which is configured by the tip end portion 15*b* of the specific movable contact 8*b* are disposed closely to one another. When each of the specific stationary contacts 5*b* is downward extended from the rear end portion in the insulator 3 without causing positional shifting toward the inside with respect to the specific stationary contact 5*b*, i.e., about the center line CL4, the specific stationary contact 5*b* interferes with the engaging portion of the specific movable contact 8*b* with respect to the insulator 3. As shown in FIGS. 4B, 6B, and 8B, in each of the specific stationary contacts 5*b*, therefore, a bent portion 16*b* is disposed which is extended from the rear end portion in the insulator 3 in a downward oblique direction (a left downward direction in the left-end specific stationary contact 5*b*, and a right downward direction in the right-end specific stationary contact 5*b*), so as to be remoter from the engaging portion of the specific movable contact 8*b* with respect to the insulator 3, as more downward advancing. Namely, the continuous portion 13*b* of the specific movable contact 8*b*, and the bent portion 16*b* of the specific stationary contact 5*b* are extended downward obliquely in opposite or outward and inward (rightward and leftward) directions.

In the rear end portion of each of the specific stationary contacts 5*b*, a chamfered portion 17 is disposed by obliquely cutting off an edge portion which is in front of the contact portion 11 of the specific movable contact 8*b*, and a part of the engaging portion which is used for engaging the specific movable contact 8*b* with the insulator 3 is positioned by biting into the chamfered region of the chamfered portion 17.

In the above-described configuration, the tip end portions 15*a* of the ordinary movable contacts 8*a* and the tip end portions 15*b* of the specific movable contacts 8*b*, i.e., the tip end portions which are more forward than the contact portions 11 of all of the specific movable contacts 8*b* do not interfere with all of the stationary contacts 5, and, when the connector plug 1 is not inserted, before the movable contacts 8 are caused to return to a free position by the elasticity of the spring portions 10, the tip end portions are engaged from the lower side with the contact engaging portions 14*a*, 14*b* disposed in the insulator 3, thereby preloading the movable contacts 8.

As seen from the above description, in the connector plug 1, the plurality of stationary contacts 5 are arranged on the insulator 3, the plurality of cantilevered movable contacts 8 are arranged in rear of the stationary contacts 5 while the tip end sides are placed in the front side, at least one specific stationary contact 5*b* of the stationary contacts 5 and at least one specific movable contact 8*b* of the movable contacts 8 are arranged in substantially one row in a state where the specific contacts are anteroposteriorly close to each other, and the specific movable contact 8*b* has the tip end portion 15*b* which is more forward than the contact portion 11, and which is positionally shifted from the contact portion 11 in one of rightward and leftward directions. Therefore, the tip end portion 15*b* of the specific movable contact 8*b* can be engaged with the insulator 3 without causing interference with the specific stationary contact 5*b*, and the tip end portions of all of the movable contacts 5 can be engaged with the insulator 3. Consequently, the levels of the contact portions 11 of the movable contacts 5 in the initial state are stabilized, and hence a stable contact pressure can be obtained. Moreover, the movable contacts 5 can be preloaded, and hence the levels of the contact portions 11 in the initial state can be lowered as compared with the movable contacts in which the tip end portions are not engaged with the insulator, so that buckling hardly occurs in the movable contacts 8.

The tip end portion 15*b* of each of the specific movable contacts 8*b* is formed at the position which is below the specific stationary contact 5*b*, and which is shifted in one of rightward and leftward directions from the specific stationary contact 5*b*, through the continuous portion 13*b* which is downward obliquely extended in one of rightward and leftward directions from the contact portion 11 of the specific movable contact 8*b*, and, before the specific movable contact 8*b* returns to the free position, engaged with the contact engaging portion 14*b* disposed in the insulator 3. Therefore, the tip end portion 15*b* of the specific movable contact 8*b* can be engaged with the insulator 3 in a stabilized state while adequately avoiding interference with the specific stationary contact 5*b*.

The rear end portion of the specific stationary contact 5*b* and the continuous portion 13*b* of the specific movable contact 8*b* are obliquely downward extended in laterally opposite directions. Therefore, interference with the tip end portion 15*b* of the specific movable contact 8*b* can be adequately avoided, and the engagement of the tip end portion 15*b* of the specific movable contact 8*b* with the insulator 3 is not impeded.

At least one chamfered portion 17 is disposed in the specific stationary contact 5*b*, and the chamfered region of the chamfered portion 17 is in front of the contact portion 11 of the specific movable contact 8*b*. While suppressing the positional shifting amount of the tip end portion 15*b* of the specific movable contact 8*b* with respect to the contact portion 11 of the specific movable contact 8*b*, therefore, the engagement area of the tip end portion 15*b* of the specific movable contact 8*b* with the insulator 3 can be increased.

Then, four stationary contacts 5 and five movable contacts 8 are disposed to constitute the connector plug 1 of a USB connector in which the number of contacts is increased. Therefore, the transmission speed in a USB connection can be increased while stabilizing the contact positions in the USB connector.

FIGS. 9A to 12B show modifications of the shape of the tip end portion of the specific movable contact 8*b*. In a first modification shown in FIGS. 9A and 9B, a continuous portion 13*c* which is extended from the contact portion 11 of the specific movable contact 8*b* in the sequence of the downward direction and the lateral direction to form an L-like shape in a front view is disposed, and a tip end portion 15*c* of the specific movable contact 8*b* which is engaged from the lower side with the contact engaging portion disposed in the insulator 3 is formed at a position which is outward positionally shifted from the contact portion 11 by the portion (tip end portion) which is laterally extended through the portion of the continuous portion 13*c* that is downward extended, and which is outward eccentric about the center line CL3.

Figure 10A:
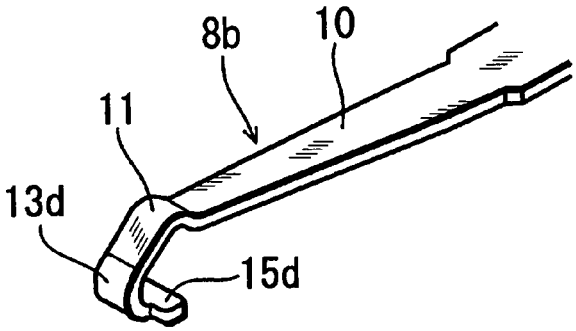
FIG. 10A is a perspective view showing a second modification of the shape of the tip end portion of the specific movable contact portion of the connector of the embodiment of the invention.
Figure 10B:
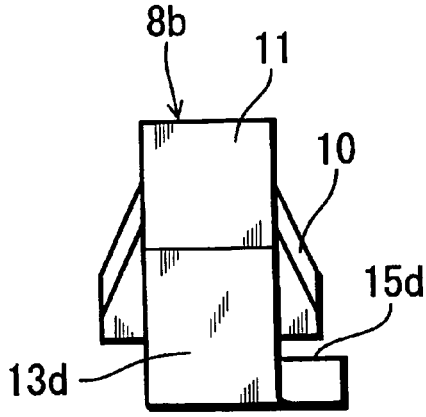
FIG. 10B is a front view showing the second modification of the shape of the shape of the tip end portion of the specific movable contact portion of the connector of the embodiment of the invention.

In a second modification shown in FIGS. 10A and 10B, a continuous portion 13*d* which is extended from the contact portion 11 of the specific movable contact 8*b* in the sequence of the downward direction and the lateral direction to form an L-like shape in a front view is disposed, the portion of the continuous portion 13*d* which is downward extended is arcuately bent at the middle to be rearward extended to below the contact portion 11, and a tip end portion 15*d* of the specific movable contact 8*b* which is engaged from the lower side with the contact engaging portion disposed in the insulator 3 is formed at a position which is outward positionally shifted from the contact portion 11 by the portion (tip end portion) which is laterally extended through the portion of the continuous portion 13*d* that is rearward extended, and which is outward eccentric about the center line CL3.

Figure 11A:
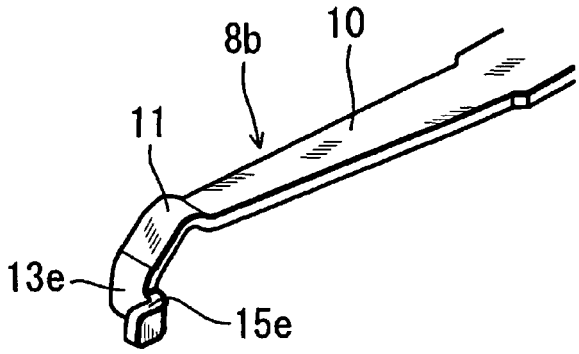
FIG. 11A is a perspective view showing a third modification of the shape of the tip end portion of the specific movable contact portion of the connector of the embodiment of the invention.
Figure 11B:
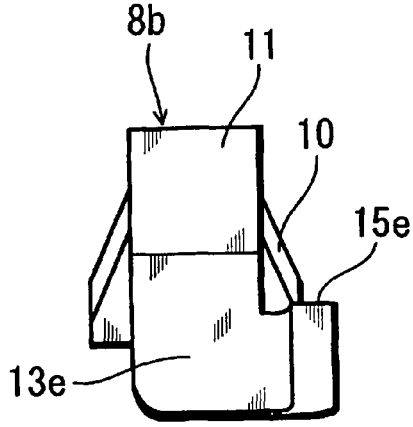
FIG. 11B is a front view showing the third modification of the shape of the shape of the tip end portion of the specific movable contact portion of the connector of the embodiment of the invention.

In a third modification shown in FIGS. 11A and 11B, a continuous portion 13*e* which is extended from the contact portion 11 of the specific movable contact 8*b* in the sequence of the downward direction and the lateral direction to form an L-like shape in a front view is disposed, the portion of the continuous portion 13*e* which is laterally extended is perpendicularly bent to be forward extended, and a tip end portion 15*e* of the specific movable contact 8*b* which is engaged from the lower side with the contact engaging portion disposed in the insulator 3 is formed at a position which is outward positionally shifted from the contact portion 11 by the portion (tip end portion) which is forward extended through the portion of the continuous portion 13*e* that is downward extended, and which is outward eccentric about the center line CL3.

Figure 12A:
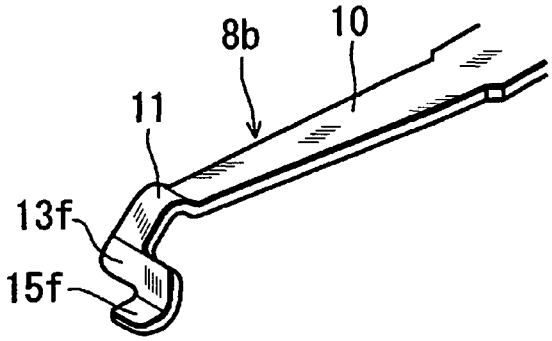
FIG. 12A is a perspective view showing a fourth modification of the shape of the tip end portion of the specific movable contact portion of the connector of the embodiment of the invention.
Figure 12B:
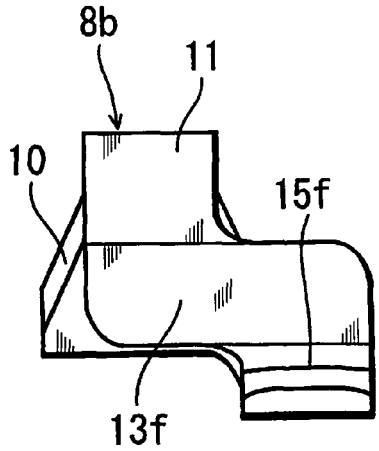
FIG. 12B is a front view showing the fourth modification of the shape of the shape of the tip end portion of the specific movable contact portion of the connector of the embodiment of the invention.

In a fourth modification shown in FIGS. 12A and 12B, a continuous portion 13*f* which is extended from the contact portion 11 of the specific movable contact 8*b* in the sequence of the downward direction, the lateral direction, and the downward direction to form a crank shape in a front view is disposed, the portion of the continuous portion 13*f* which is downward extended through the portion that is laterally extended is perpendicularly bent to be forward extended, and a tip end portion 15*f* of the specific movable contact 8*b* which is engaged from the lower side with the contact engaging portion disposed in the insulator 3 is formed at a position which is outward positionally shifted from the contact portion 11 by the portion (tip end portion) which is forward extended through the portion of the continuous portion 13*f* that is laterally extended, and which is outward eccentric about the center line CL3.

The shape of the tip end portion of the specific movable contact 8*b* will be described. In the first to fourth modifications shown in FIGS. 9A to 12B, the continuous portions 13*c*, 13*d*, 13*e*, 13*f* are downward extended from the contact portion 11. In the example shown in FIGS. 7C and 7D, by contrast, the continuous portion 13*b* is downward obliquely extended from the contact portion 11 in one of rightward and leftward directions, and, in the case where the rear end portion of the specific stationary contact 5*b* is rearward extended through the bent portion 16*b* which is downward obliquely in a lateral direction that is opposite to the continuous portion 13*b*, to form the external connection terminal 6, the oblique angle (the escape angle of the insulator 3 with respect to the engaging portion of the specific movable contact 8*b*) of the bent portion 16*b* can be therefore reduced as compared with the continuous portions 13*c*, 13*d*, 13*e*, 13*f* of the first to fourth modifications shown in FIGS. 9A to 12B. Consequently, interference with the tip end portion 15*b* of the specific movable contact 8*b* can be easily avoided.

In the first and third modifications shown in FIGS. 9 and 11, the engagement with the contact engaging portion disposed in the insulator 3 is performed by means of the thin side end face of the specific movable contact 8*b*. In the example shown in FIGS. 7C and 7D, by contrast, the engagement with the contact engaging portion disposed in the insulator 3 is performed by means of the principal face of the specific movable contact 8*b*. Therefore, a recess or an engagement due to the recess (an operation failure of the specific movable contact 8*b*) is not caused in the contact engaging portion disposed in the insulator 3 which is made of an insulating material such as a synthetic resin, and the tip end portion 15*b* of the specific movable contact 8*b* can be stably engaged with the contact engaging portion disposed in the insulator 3.

Figure 7A:
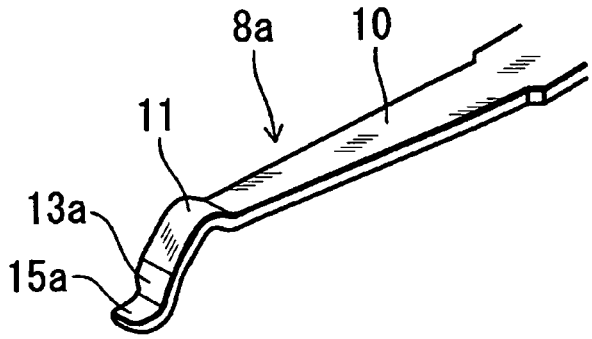
FIG. 7A is a perspective view showing the shape of a tip end portion of the ordinary movable contact portion of the connector of the embodiment of the invention.
Figure 7B:
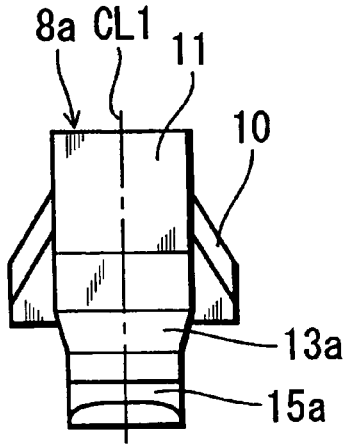
FIG. 7B is a front view showing the shape of the tip end portion of the ordinary movable contact portion of the connector of the embodiment of the invention.
Figure 7C:
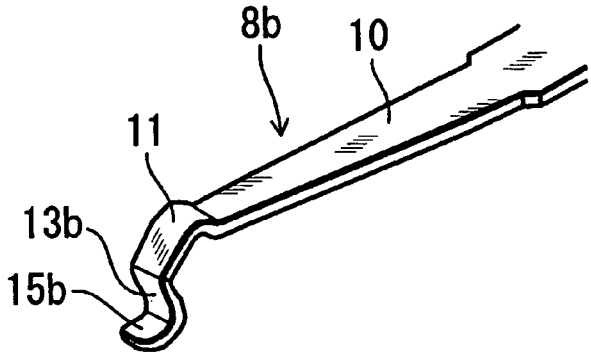
FIG. 7C is a perspective view showing the shape of a tip end portion of the specific movable contact portion of the connector of the embodiment of the invention.
Figure 7D:
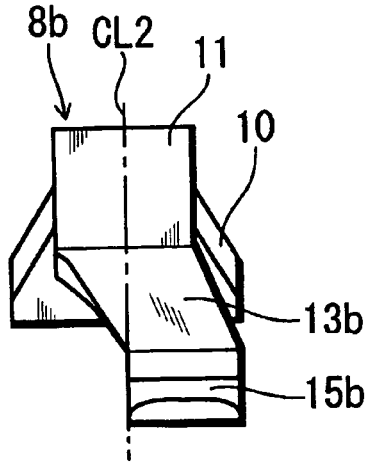
FIG. 7D is a front view showing the shape of the tip end portion of the specific movable contact portion of the connector of the embodiment of the invention.

In molding of the shape of the tip end portion of the specific movable contact 8*b*, the second and third modifications shown in FIGS. 10 and 11 require a plurality of bending steps, and by contrast the example shown in FIGS. 7C and 7D requires bending steps the number of which is smaller than that required in the second and third modifications shown in FIGS. 10 and 11, and hence is excellent in productivity of the movable contact 8.

The punched shape of the specific movable contact 8*b* will be described. In the first to fourth modifications shown in FIGS. 9 to 12, the continuous portions 13*c*, 13*d*, 13*e*, 13*f* have the portion which is extended perpendicularly to the extension direction of the specific movable contact 8*b*. In the example shown in FIGS. 7C and 7D, by contrast, the continuous portion 13*b* and the tip end portion 15*b* are extended in a direction which is approximately identical with the extension direction of the specific movable contact 8*b*, and do not have a portion which is extended perpendicularly to the extension direction. Therefore, the layout yield of the movable contacts 8 is higher than that in the first to fourth modifications shown in FIGS. 9 to 12.

Although the preferred embodiment of the connector of the invention has been described by means of the connector plug 1 of the USB connector in which the number of contacts is increased from four in the prior art by five to nine, the invention is not restricted to the embodiment, and can be variously modified without departing from the spirit and scope of the invention.

DESCRIPTION OF REFERENCE NUMERALS

1 connector plug (USB connector)
3 insulator
5 stationary contact
5*b* specific stationary contact
8 movable contact
8*b* specific movable contact
11 contact portion
13*b* continuous portion
14*b* contact engaging portion
15*b* tip end portion
16*b* bent portion
17 chamfered portion
CL1 to CL4 center line

What is claimed is:

1. A connector wherein a plurality of stationary contacts are arranged on an insulator, a plurality of cantilevered movable contacts are arranged in rear of said stationary contacts while tip end sides are placed in a front side, at least one specific stationary contact of said stationary contacts and at least one specific movable contact of said movable contacts are arranged in substantially one row in a state where said specific contacts are anteroposteriorly close to each other, and said specific movable contact has a tip end portion which is more forward than a contact portion, and which is positionally shifted from said contact portion in one of rightward and leftward directions.

2. A connector according to claim 1, wherein said tip end portion of said specific movable contact is formed at a position which is below said specific stationary contact, and which is shifted in one of rightward and leftward directions from said specific stationary contact, through a continuous portion which is downward obliquely extended in one of rightward and leftward directions from said contact portion of said specific movable contact, and engaged with a contact engaging portion disposed in said insulator, before said specific movable contact returns to a free position.

3. A connector according to claim 1, wherein said tip end portion of said specific movable contact is formed at a position which is below said specific stationary contact, and which is shifted in one of rightward and leftward directions from said specific stationary contact, through a continuous portion which is downward obliquely extended in one of rightward and leftward directions from said contact portion of said specific movable contact, engaged with a contact engaging portion disposed in said insulator, before said specific movable contact returns to a free position, and a rear end portion of said specific stationary contact is downward obliquely extended in another one of rightward and leftward directions, the other direction being opposite to said continuous portion of said specific movable contact.

4. A connector according to claim 1, wherein at least one chamfered portion is disposed in said specific stationary contact, and a chamfered region of said chamfered portion is in front of said contact portion of said specific movable contact.

5. A connector according to claim 1, wherein the number of said stationary contacts is four, and the number of said movable contacts is five, thereby constituting of a USB connector.

* * * * *